US006155864A

United States Patent [19]

Yoshiura

[11] Patent Number: 6,155,864

[45] Date of Patent: Dec. 5, 2000

[54] CONNECTOR LOCKING STRUCTURE

[75] Inventor: Yasuo Yoshiura, Tokyo, Japan

[73] Assignee: SMK Corporation, Japan

[21] Appl. No.: 09/329,779

[22] Filed: Jun. 10, 1999

[30] Foreign Application Priority Data

Jun. 16, 1998 [JP] Japan ..... 10-185593

[51] Int. Cl.[7] ..... H01R 13/627

[52] U.S. Cl. ..... 439/357

[58] Field of Search ..... 439/357, 358, 439/353

[56] References Cited

U.S. PATENT DOCUMENTS 5,613,865 3/1997 Dullin et al. ..... 439/353

5,775,931 7/1998 Jones ..... 439/358

*Primary Examiner*—Neil Abrams
*Assistant Examiner*—Javaid Nasri
*Attorney, Agent, or Firm*—Morrison Law Firm

[57] ABSTRACT

Lock arms on both sides of a connector have locking protuberances which lock into indentations of a mate connector. One side of the each of the lock arms as well as the sides along the indentation have tapered edges. The sides of the connector can be twisted with respect to each other. During twisting the tapered edges engage to raise the locking protuberances out of engagement with the indentations, thereby permitting easy disconnection of the connectors. The result is a connector locking structure which is easily disconnected but which positively resists unintended disconnection.

9 Claims, 10 Drawing Sheets

(Prior Art)

CONNECTOR LOCKING STRUCTURE

BACKGROUND OF THE INVENTION

The present invention relates to a connector locking structure. More particularly, the present invention relates to a connector locking structure where the connector remains locked when pulled in the direction in which the connector was inserted into another connector. Even more particularly, the present invention relates to a connector locking structure which permits the unlocking of a connector only when the connector is twisted.

Referring to FIG. 16, a conventional connector 100 includes a plurality of terminals (not shown) retained in an insulating housing 101. Lock arms 103 are integrally formed with the insulating housing 101. A locking protuberance 104, at the leading end of the lock arm 103, projects toward the outside of the insulating housing 101. The lock arms 103 are elastically deformable sideward in the plane of the drawing sheet of FIG. 16.

Referring to FIG. 17, the locking protuberance 104 includes side surfaces 106 forming right angles with a tapered locking surface 108. A first flat surface 105, and a second flat surface 107 create planar surfaces parallel to each other. The tapered locking surface 108 is tilted relative to the first flat surface 105 and the second flat surface 107.

Referring now also to FIG. 16, the connector 110 mates with the connector 100. Connector 110 includes a plurality of terminals 112 retained in an insulating housing 111. The terminals 112 are brought into contact with their corresponding terminals of the connector 100 when the units are mated. First and second window holes 113 (only one of which is shown in the cross section) are included in opposed side surfaces of the insulating housing 111. A tapered locking surface 114, located at the edge of each of the window holes 113, tapers down toward thc open end of the connector 110 (i.e., the lower end of the window hole 113 in FIG. 16).

When the connector 100 and its mate connector 110 are fitted together, the lock arms 103 are elastically deformed toward the inside of the connector. When the locking protuberances 104 reach the window holes 113, the lock arms 103 return outwardly to their original positions under their own restoration forces. The locking protuberances 104 engage their respective window holes 113. In this mated condition, the terminals of the connector 100 are mechanically and electrically connected to their respective terminals of the connector 111. The tapered locking surfaces 108 of the locking protuberances 104 are resiliently urged into contact with their respective tapered locking surfaces 114 of the window holes 113, to maintain the mated condition.

This type of locking mechanism is an auxiliary system. When the connector 100 is pulled downward, the tapered locking surfaces 108 slide over their corresponding tapered locking surface 114. The locked state of connector 100 with its mated connector 110 is thus readily disengaged.

Referring to FIG. 18, another conventional connector 200 includes a plurality of terminals (not shown) retained in an insulating housing 201. Lock arms 203 are integrally formed with the insulating housing 201. A groove 204 longitudinally formed in the vicinity of the base of the lock arm 203, permits flexing of the lock arm 203 in the plane of the drawing sheet of FIG. 18. A locking protuberance 205 at the leading end of the lock arms 203 projects toward the outside of the insulating housing 201. An unlocking button 206, integrally with an intermediate portion of the lock arm 203, extends outward from the insulating housing 201 to an exposed position where it can be pressed by a user to release the locked condition.

Referring to FIG. 19, the locking protuberance 205 includes side surfaces 209 forming right angles with a vertical locking surface 207. A first flat surface 206, and a second flat surface 208 create planar surfaces parallel to each other. The vertical locking surface 207 is tilted relative to the first flat surface 206 and the second flat surface 208.

Returning to FIG. 18, a connector 210 mates with the connector 200. Connector 210 includes a plurality of terminals 212 in an insulating housing 211. The terminals 212 are brought into contact with their corresponding terminals of the connector 200. A window hole 213 is included the side surface of the insulating housing 211. A vertical locking surface 214, located at the edge of the window hole 213, faces the open end of the connector 210 (i.e., the lower end of the window hole 213 in FIG. 16). A right angle is formed between the vertical locking surface 214 and the direction in which the connector 210 is inserted into its mate connector 200.

When the connector 200 and its mate connector 210 fit together, the lock arms 203 are elastically deformed toward the inside of the connector. When the locking protuberance 205 reaches the window hole 213, the lock arms 203 return outwardly to their original positions under their own restoration forces. Each of the locking protuberances 204 engage with their respective window holes 213. The terminals of the connector 200 are electrically connected to their mate terminals of the connector 211. The vertical locking surface 207 of the locking protuberance 205 contacts the vertical locking surface 214 of the window hole 213.

To disengage the connector 200 from its mated connector 210, the unlocking buttons 206 are pressed to elastically deform the lock arms 203 toward the grooves 204. The locking protuberances 205 are disengaged from their respective window holes 213. The connector 200 is then disengaged from its mate 210 by pulling the connector 200 downward.

When a user wishes to disconnect the connectors, the conventional connector 100 of FIG. 16, is readily disconnected. Even when the user does not wish to disconnect the connectors, however, the connectors are readily disconnected with only a relatively small external force applied to the connectors.

Connector 200 prevents such unintended disconnection of the connector by providing a positive locking mechanism. The user must press the unlocking buttons 206 to disconnect the connectors. The operation of connector 200 is difficult when it is located in an area of limited accessibility. For example, disconnecting connector 200 from its mate connector 210 is very laborious when the connectors are located behind a device, or in a region of close clearances.

Furthermore, the lock arms 203 much be elastically deformed until the locking protuberances 205 are disengaged from their respective window holes 213. Some users may press the unlocking button 206 with more force than necessary, thereby damaging the locking arms 203. This is a particular problem when the connector itself is made compact in association with the recent trend toward miniaturization. In very small connectors, the lock arms 203 are formed to be slender and are even more susceptible to fracture.

OBJECTS AND SUMMARY OF THE INVENTION

It is an object of the invention to provide a connector locking structure which overcomes the foregoing problems.

It is a further object of the invention to provide a connector locking structure prevents disconnection when the connector is pulled in the direction in which it was inserted.

It is a further object of the invention to provide such a connector locking structure which is disconnected by twisting the connector.

Briefly stated, the present invention provides lock arms on both sides of a connector having locking protuberances which lock into indentations of a mate connector. One side of the each of the lock arms as well as the sides along the indentation have tapered edges. The sides of the connector can be twisted with respect to each other. During twisting the tapered edges engage to raise the locking protuberances out of engagement with the indentations, thereby permitting easy disconnection of the connectors. The result is a connector locking structure which is easily disconnected but which positively resists unintended disconnection.

According to an embodiment of the invention, there is provided a connector locking structure comprising: a connector; the connector including an insulating housing; a plurality of terminals partially exposed to an exterior of the insulating housing; lock arms projecting from the insulating housing; the lock arms being elastically deformable in a direction generally normal to a direction of insertion of the connector; locking protuberances are integrally formed at ends of the lock arms; the locking protuberances projecting in a direction generally normal to the direction of insertion of the connector; a tapered unlocking surface on each of the lock arms; the tapered unlocking surface being parallel to the direction of insertion of the connector; the tapered unlocking surface tapering in a vertical direction perpendicular to the direction of insertion of the connector; a mate connector; the mate connector including an insulating housing; a plurality of terminals partially exposed to an exterior of the insulating housing; at least one indentation positioned to receive and engage the locking protuberances; a tapered unlocking surface on each of the indentations; the tapered unlocking surfaces being parallel to the direction of insertion of the connector; the tapered unlocking surfaces tapering down in a vertical direction perpendicular to the direction of insertion of the connector; the terminals of the connector and the terminals of the mate connector are connected by insertion and engagement of the locking protuberance of the connector with the indentation of the mate connector; means in at least one of the connector and the mate connector to permit relative twisting thereof; and the tapered unlocking surface of the connector slide over the tapered unlocking surface of the mate connector to displace the locking protuberance out of locking engagement with the indentation, whereby disengagement of the connector from the mate connector is enabled.

According to another embodiment of the invention, there is provided a connector system comprising a connector; a mate connector mateable to the connector; at least one of the mate connector and the connector including a lock arm extending toward the other thereof; the lock arm including a locking surface; the other including an indentation into which the locking surface is resiliently urged when the connector and the mate connector are engaged; at least a first tapered unlocking surface on the lock arm; at least a corresponding second tapered unlocking surface on the other; means for permitting twisting of the connector relative to the mate connector; and the twisting engaging the first and second tapered unlocking surfaces to raise the locking surface out of engagement with the indentation, whereby unlocking and disconnection of the connector and the mate connector is enabled.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 12(*b*) is another cross-sectional view taken along line Z—Z of FIG. 11 of two tapered unlocking surfaces when a connector and its mate connector are disconnected from each other.

FIG. 13(*b*) is a cross-sectional view of two tapered unlocking surfaces when a connector and its mate connector are disconnected from each other.

FIG. 14(*b*) is a cross-sectional view of two tapered unlocking surfaces when a connector and its mate connector are disconnected from each other.

DETAILED DESCRIPTION OF THE PREFERRED EMBODIMENT

Figure 1:
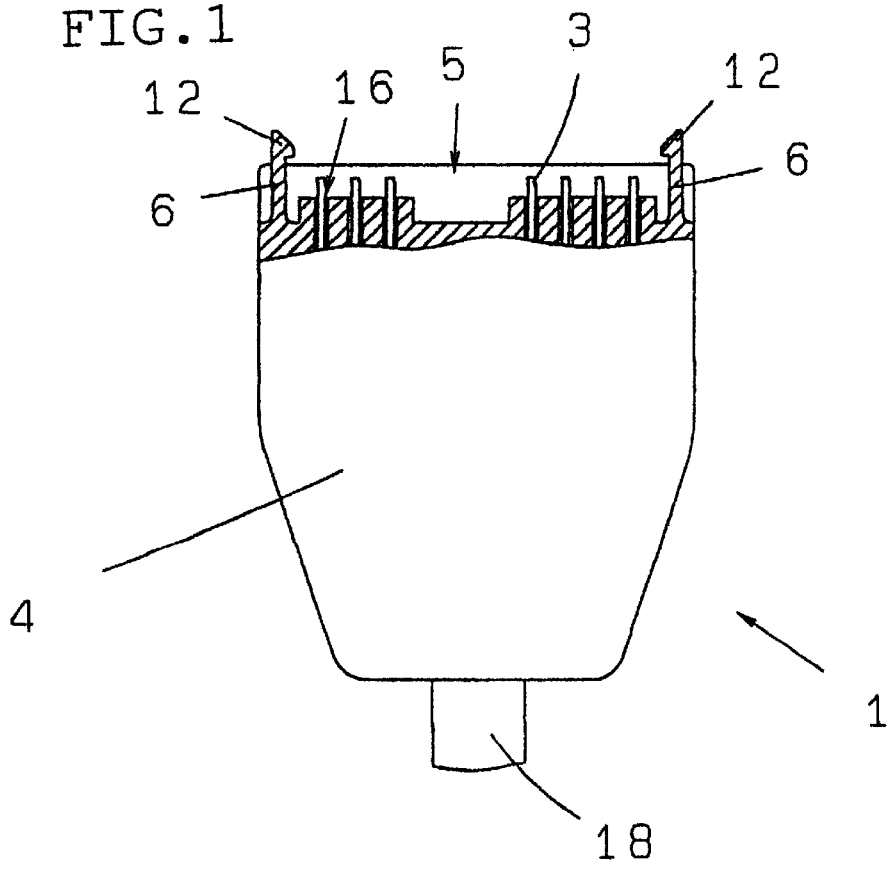
FIG. 1 is a partially cutaway plan view of a connector according to an embodiment of the present invention.
Figure 2:
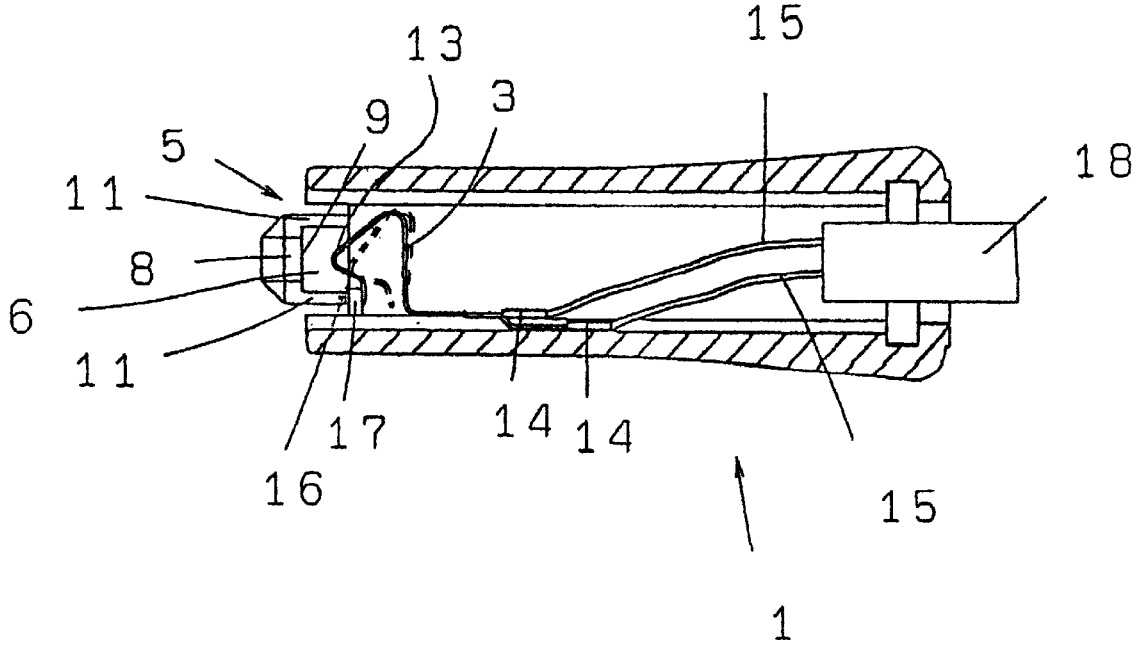
FIG. 2 is a cross-sectional view of a connector.

Referring to FIGS. 1 and 2, a connector 1 includes terminals 3 attached to the leading end of a cable 18 encased in an insulating housing 4. Conductors 15 of the cable 18 are electrically connected to the terminals 3.

Figure 3:
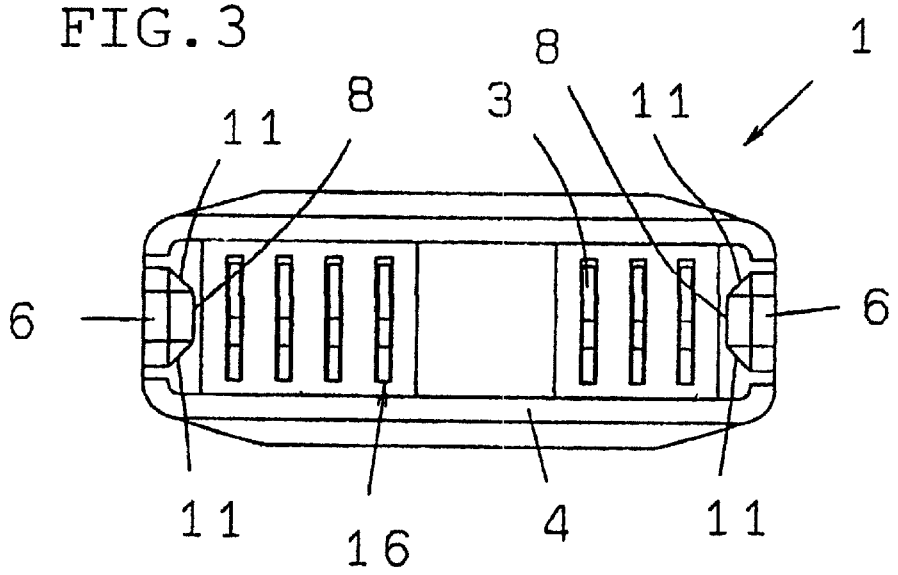
FIG. 3 is an end view of the connector of FIG. 1.

A receiving recess 5 is formed in the insulating housing 4. The receiving recess 5 fits a mate connector 2. A plurality of slit-shaped terminal projection holes 16, formed in the thickness direction of the insulating housing 4 (i.e., in a longitudinal direction of the sheet of FIG. 3), are exposed through the receiving recess 5. A terminal projection wall 17 is formed in the vicinity of the lower end of each terminal projection hole 16.

Locking arms 6, integrally formed with the insulating housing 4, project from the respective sides of the receiving recess 5 in the direction of insertion of the connector (i.e., in the upward direction of the sheet of FIG. 1). The locking arms 6 are elastically deformable to the left and right in FIG. 1.

Figure 4:
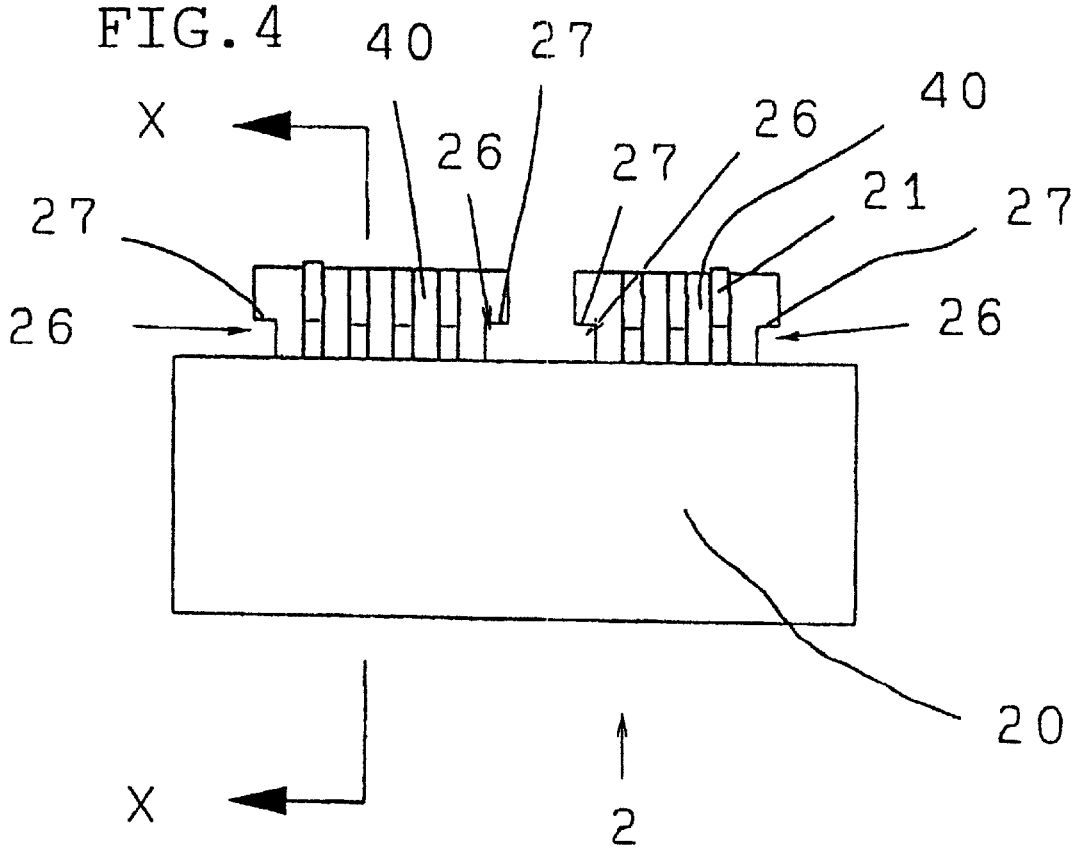
FIG. 4 is a side view of a mating connector.
Figure 5:
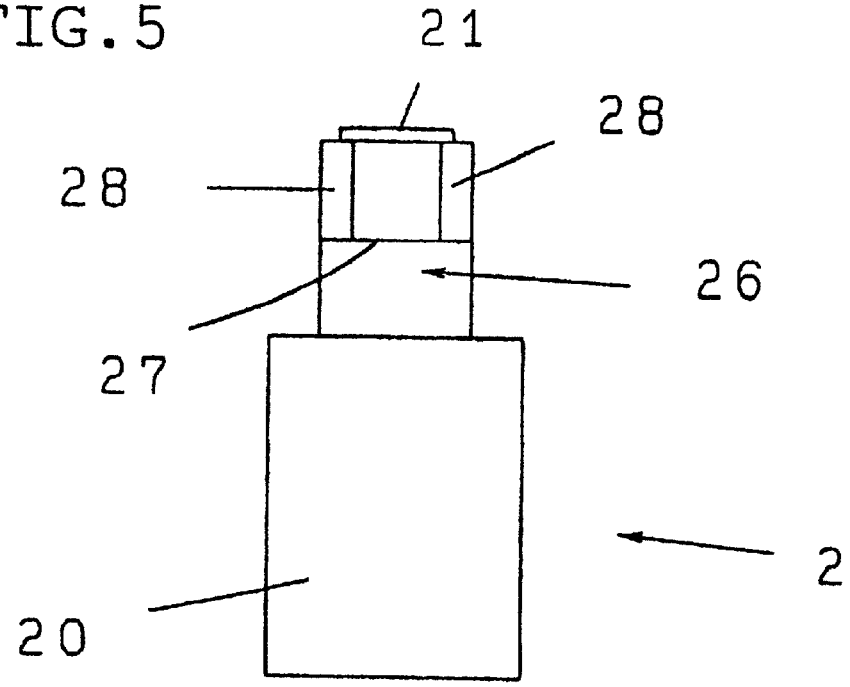
FIG. 5 is an end view of a mate connector.
Figure 6:
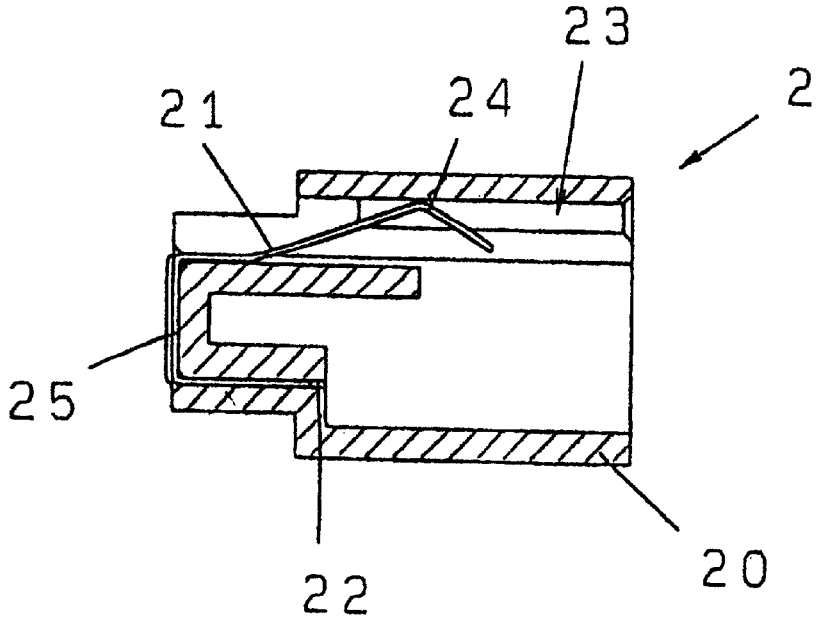
FIG. 6 is a cross-sectional view taken along the line X—X of FIG. 4.
Figure 7:
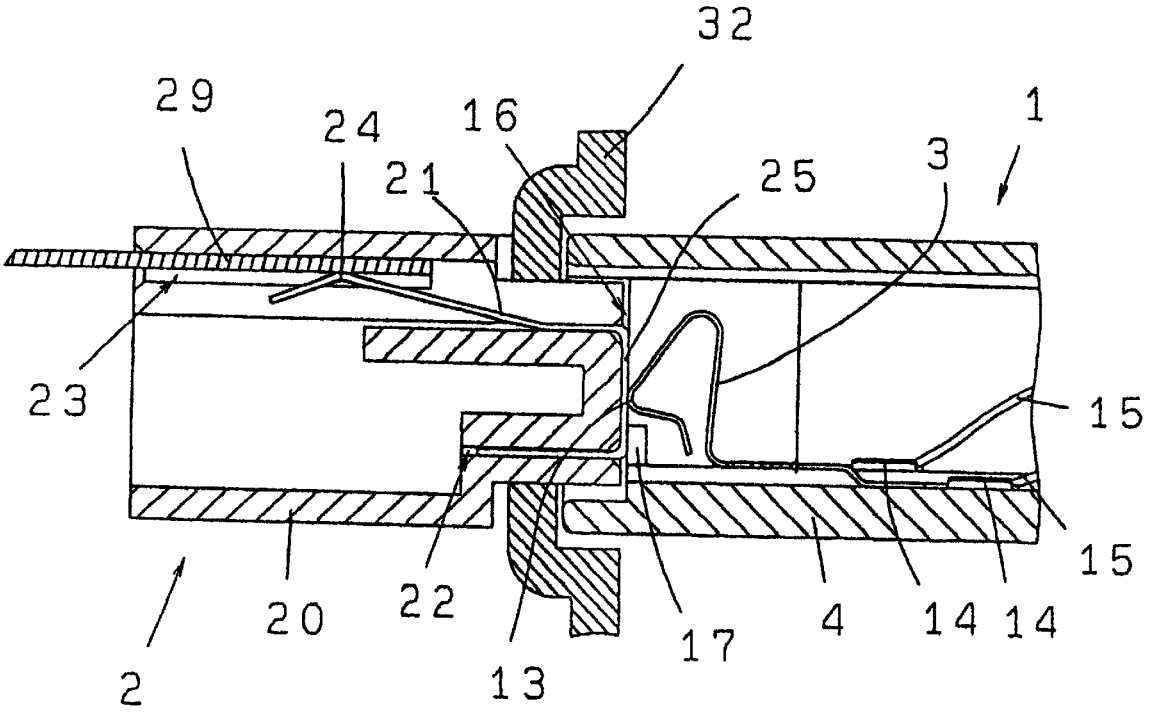
FIG. 7 is a cross-sectional view of a connector mated to its mating connector.
Figure 8:
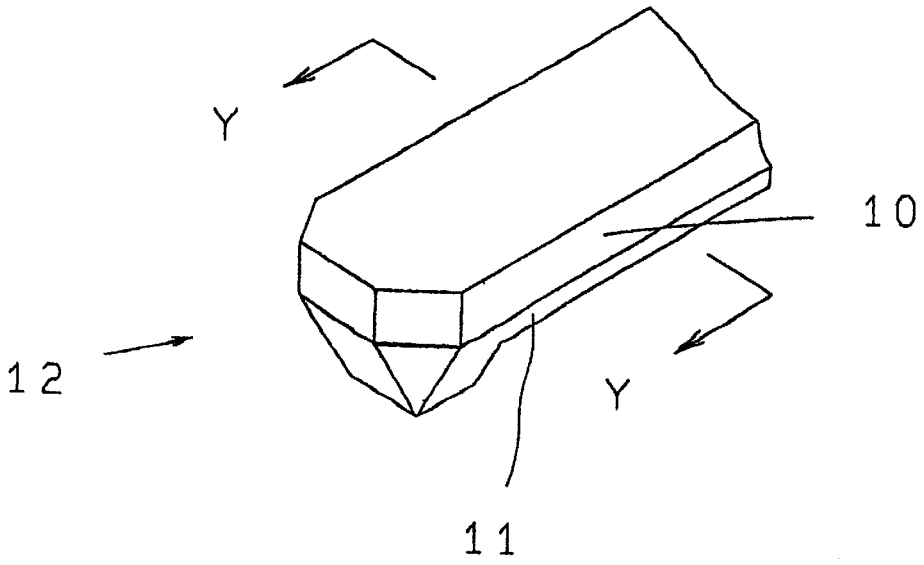
FIG. 8 is a perspective view of a locking protuberance.
Figure 9:
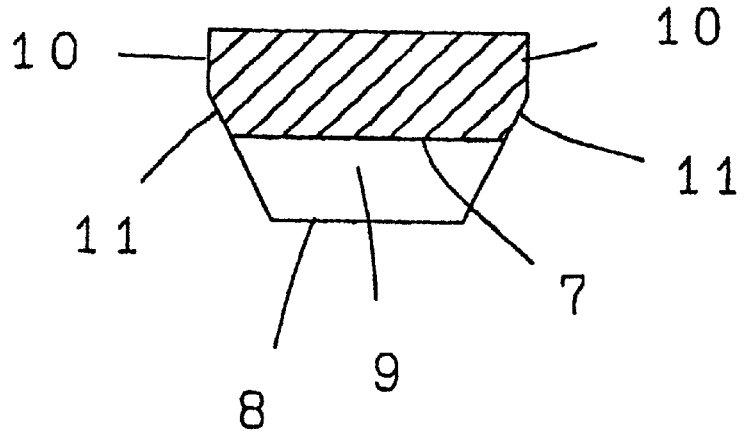
FIG. 9 is a cross-sectional view taken along line Y—Y of FIG. 8.
Figure 10:
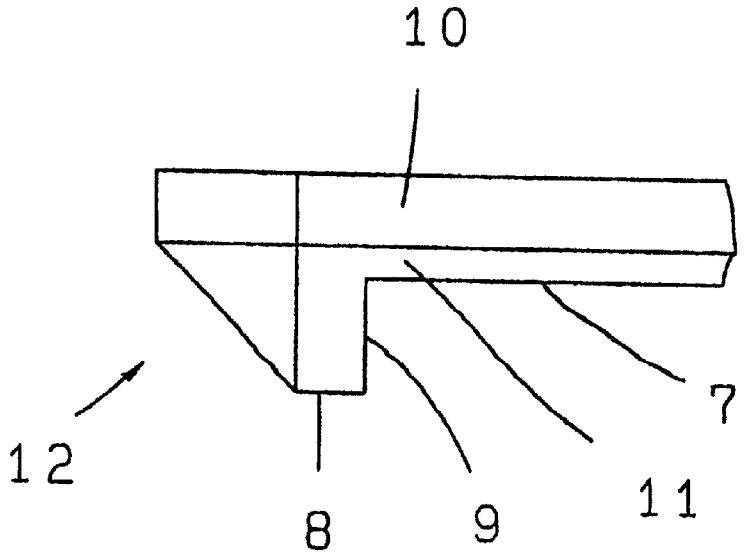
FIG. 10 is a side elevation view of a locking protuberance.
Figure 11:
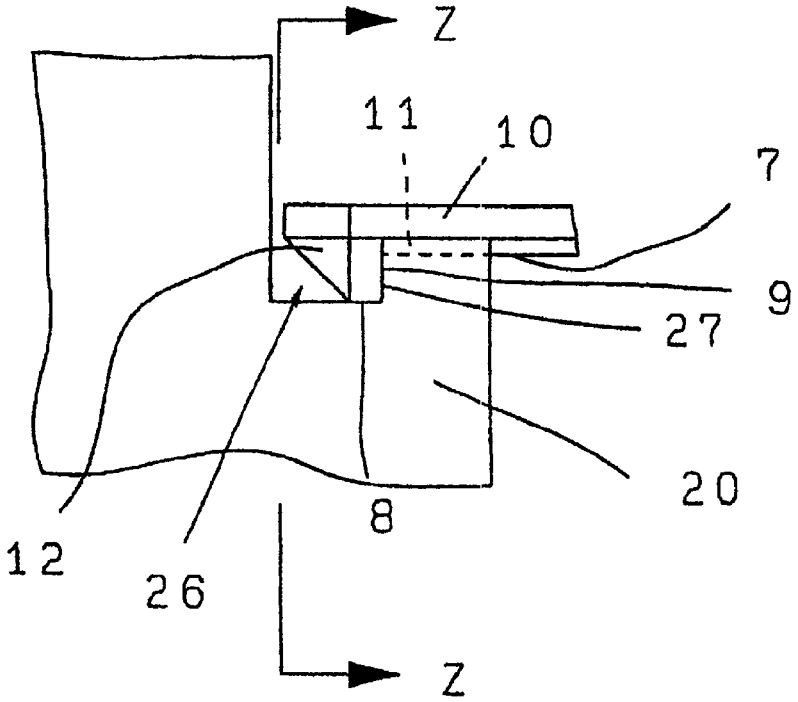
FIG. 11 is schematic representation of the relationship between two vertical locking surfaces when a connector and its mate connector are connected with each other.

A locking protuberance 12 projects from the leading end of each locking arm 6 perpendicular to the direction of insertion of the connector (i.e., the longitudinal direction of the drawing sheets of FIGS. 1 and 4).

Referring to FIGS. 8 through 11, the locking protuberance 12 includes a first flat surface 7 and a second flat surface 8 that are perpendicular to side surfaces 10. A vertical locking surface 9 is perpendicular to the first flat surface 7 and the second flat surface 8. Tapered unlocking surfaces 11 are formed along the sides of the locking arm 6. The tapered unlocking surfaces 11 extend in the direction of insertion of the connector.

Referring now to FIG. 2, the terminals 3 include a contact section 13 and a clamping section 14. When the terminal 3 comes into contact with a terminal 21 of the mate connector 2, the contact section 13 is elastically deformed in the manner indicated by the broken line in FIG. 2. The clamping section 14 is electrically connected to the end of the conductor 15 of the cable 18 by any suitable means, such as caulking, soldering, etc. When thc connector 1 is not connected to its mate connector 2, the contact section 13 projects from the terminal projection hole 16 into the receiving recess 5. The end of the contact 13 is brought into pressing contact with a terminal projection prevention wall 17.

Referring now to FIGS. 4 through 7, the mate connector 2 is mounted on the end of a circuit board 29 which is fixedly housed in a device (not shown). The mate connector 2 includes an insulating housing 20 and terminals 21. Two integrally formed protuberances 40 project from the insulating housing 20. Terminal receiving grooves 22 and a substrate insert groove 23 are formed in a widthwise direction (i.e., perpendicular to the page of the drawing sheet of FIG. 6) in the insulating housing 20.

An indentation 26 and a tapered unlocking surface 28 are formed on each side surface of each protuberance 40. The terminals 21 are exposed on the upper surface of the protuberance 40. The end of the indentation 26 is formed into a vertical locking surface 27. The tapered unlocking surfaces 28 are inclined to taper down in a vertical direction, making a right angle to the direction of insertion of the connector (i.e., in a depthwise direction of the indentation 26, or the downward direction of FIG. 12).

The terminal 21 is formed into a C shape. One end of the terminal 21 is fixedly press-fitted into the terminal receiving groove 22. An intermediate portion 25 of the terminal 21 is exposed on the front surface of the insulating housing 20. The other end of the terminal 21 is formed into a circuit board contact section 24 which makes contact with a conduction portion (not shown) of the circuit board 29. The circuit board contact section 24 is bent into an obtuse V-shape, permitting smooth insertion of the circuit board 29. The circuit board contact section 24 is elastically deformed by insertion of the circuit board 29 to generate the desired contact pressure between the terminal 21 and the circuit board 29.

Figure 12A:
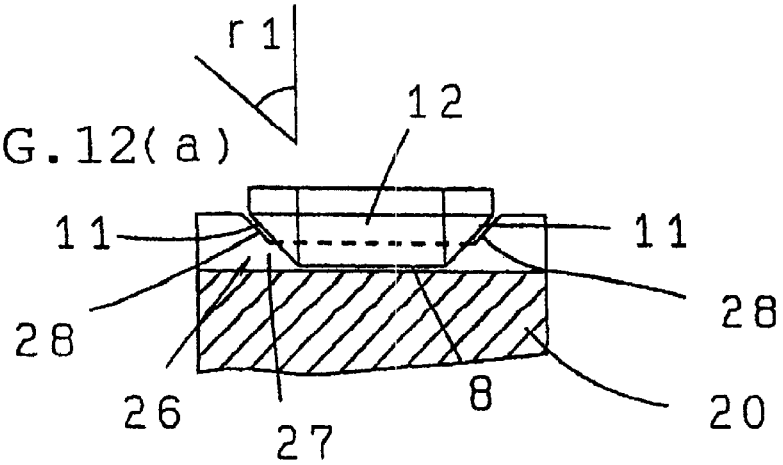
FIG. 12(*a*) is a cross-sectional view taken along line Z—Z of FIG. 11 showing two tapered unlocking surfaces when a connector and its mate connected arc connected to each other.
Figure 12B:
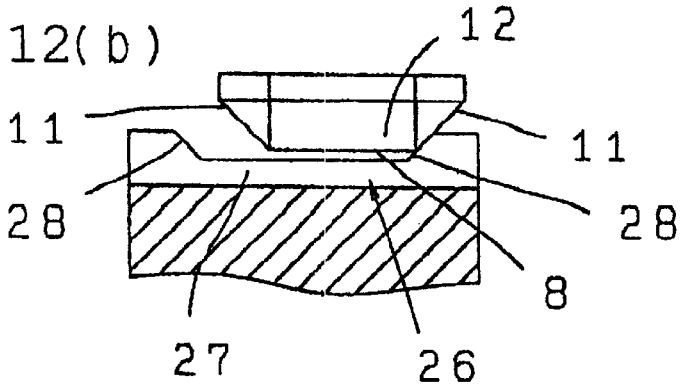

Referring to FIG. 12, tilt angle r1 is the angle that the tapered unlocking surfaces 11 of the connector 1 are tilted relative to the projection of the locking protuberance 12. The tapered unlocking surfaces 28 of the mate connector 2 are tilted to the same angle r1 relative to the depthwise direction of the indentation 26.

When the connector 1 is connected to its mate connector 2, the lock arms 6 are elastically deformed outwardly. When the locking protuberances reach the indentations 26, the lock arms 6 snap back toward their original positions under their own restoration forces. This results in the locking protuberances 12 engaging the indentations 26. In this state, the connector 1 is mechanically locked to the mate connector 2, with the terminals 3 of the connector 1 electrically connected to the terminals 21 of the mate connector 2.

When the connector 1 is pulled in a direction opposite from which it was inserted into its mate connector 2, the vertical locking surfaces 27 of the mate connector 2 engage the vertical locking surfaces 9 of the connector 1 to prevent disengagement of the connector 1 from the mate connector 2. When the vertical locking surfaces 27 are moved in a direction substantially parallel to the vertical locking surface 9 (i.e., the connector 1 is twisted), the tapered unlocking surfaces 11 of the connector 1 slide over the tapered unlocking surfaces 28 of the mate connector 2. This moves the vertical locking surfaces 27 of the mate connector out of engagement with the vertical locking surfaces 9 of the connector 1, thereby allowing for the connector 1 to be disconnected from its mate connector 2.

Figure 13A:
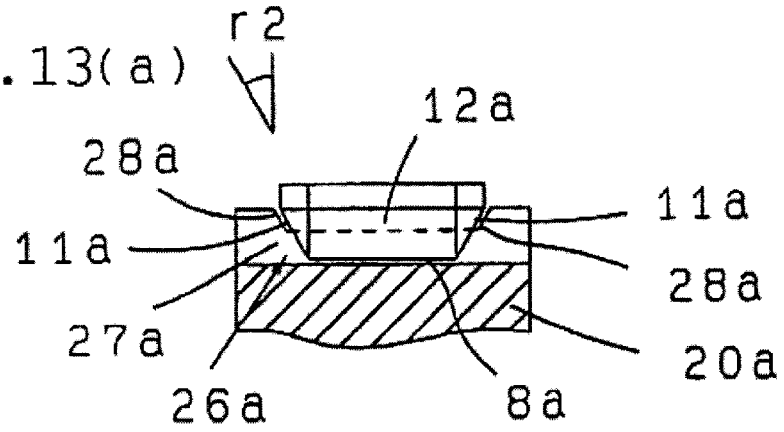
FIG. 13(*a*) is a cross-sectional view of two tapered unlocking surfaces when a connector and its mate connected are connected to each other.
Figure 13B:
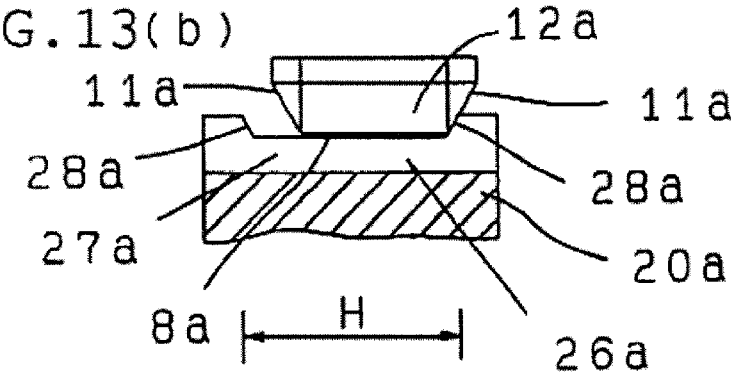

Referring now to FIGS. 13(*a*) and 13(*b*), a different tilt angle r2 is the angle that the tapered unlocking surfaces 11*a* of the connector 1 are tilted relative to the projection of the locking protuberance 12*a*. The tapered unlocking surfaces 28*a* of the mate connector 2 are tilted to the same angle r2 relative to the depthwise direction of the indentation 26*a*. The tilt angle r2 is smaller than the tilt angle r1 above. As a result, a greater twisting force is required to slide the tapered unlocking surfaces 11*a* over the tapered unlocking surfaces 28*a*. The closer the tilt 10 angle r2 comes to 0 degrees, the more difficult it is to disconnect the connector 1 from its mate connector 2. Furthermore, by decreasing the tilt angle r2, the distance H, as labeled in FIG. 13(*b*), through which the locking protuberance 12*a* must be moved, is smaller. This enables a reduction in size of the connector 1 and its mate connector 2.

Figure 14A:
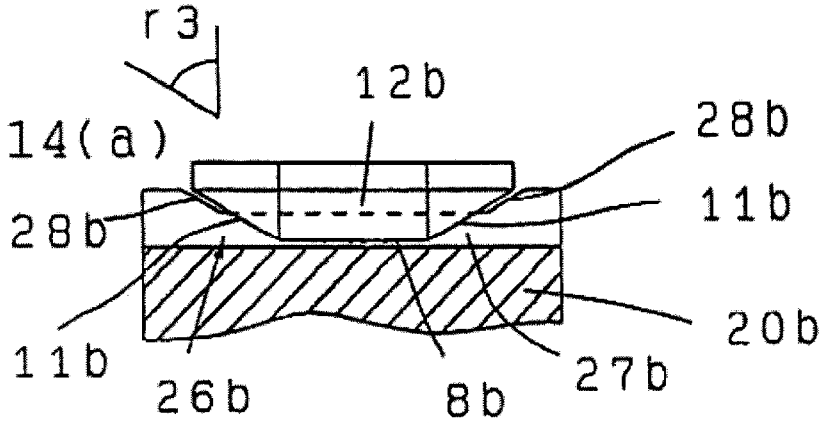
FIG. 14(*a*) is a cross-sectional view of two tapered unlocking surfaces when a connector and its mate connected are connected with each other.
Figure 14B:
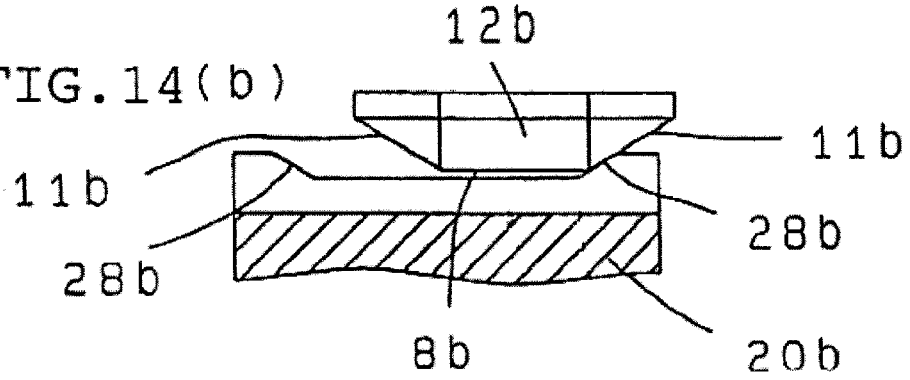

Referring now to FIGS. 14(*a*) and 14(*b*), tilt angle r3 is the angle that the tapered unlocking surfaces 11*b* of the connector 1 are tilted relative to the projection of the locking protuberance 12*b*. The tapered unlocking surfaces 28*b* of the mate connector 2 are tilted to the same angle r3 relative to the depthwise direction of the indentation 26*b*. By making this tilt angle r3 larger then the tilt angle r1 above, a lesser twisting force is required to slide the tapered unlocking surfaces 11*b* over the tapered unlocking surfaces 28*b*. The closer the tilt angle r3 comes to 90 degrees, the easier the disconnection of the connector 1 from its mate connector 2.

Figure 15:
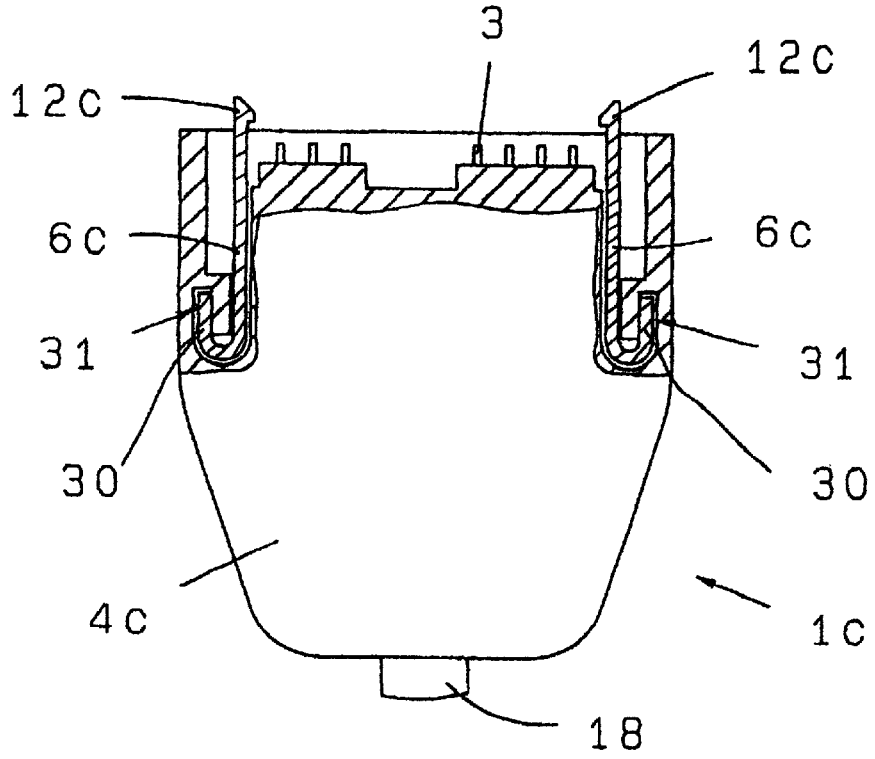
FIG. 15 is a partially cutaway plan view of a connector.
Figure 16:
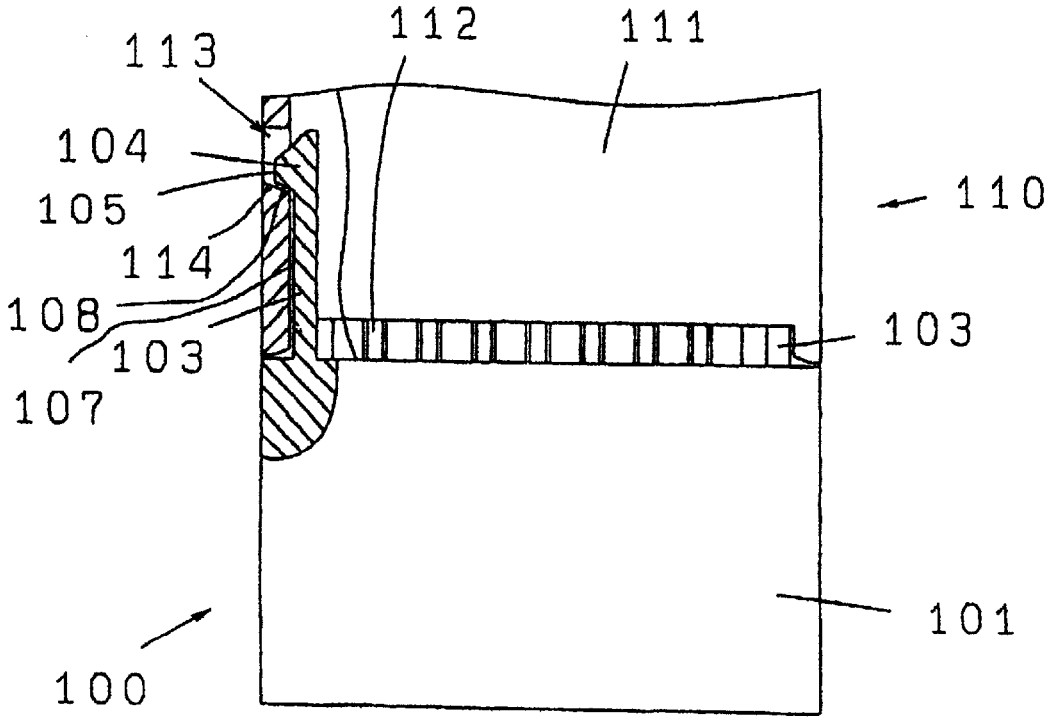
FIG. 16 is a cross-sectional view of a connector of the prior art.
Figure 17:
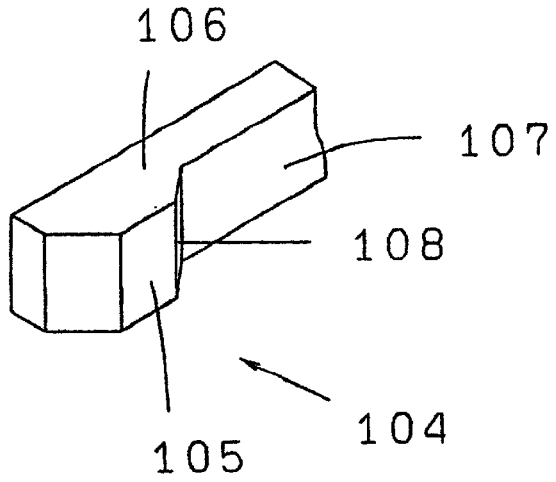
FIG. 17 is a perspective view of a connector of the prior art.
Figure 18:
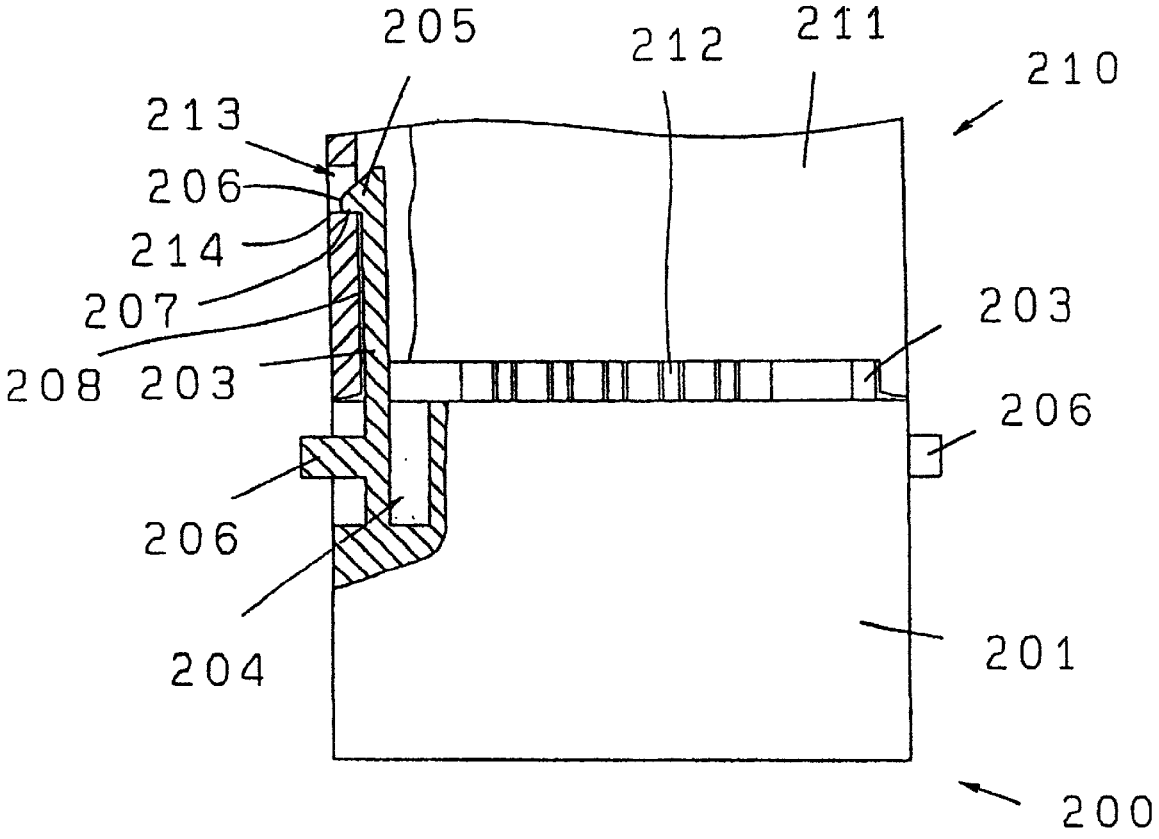
FIG. 18 is a cross-sectional view of another connector of the prior art.
Figure 19:
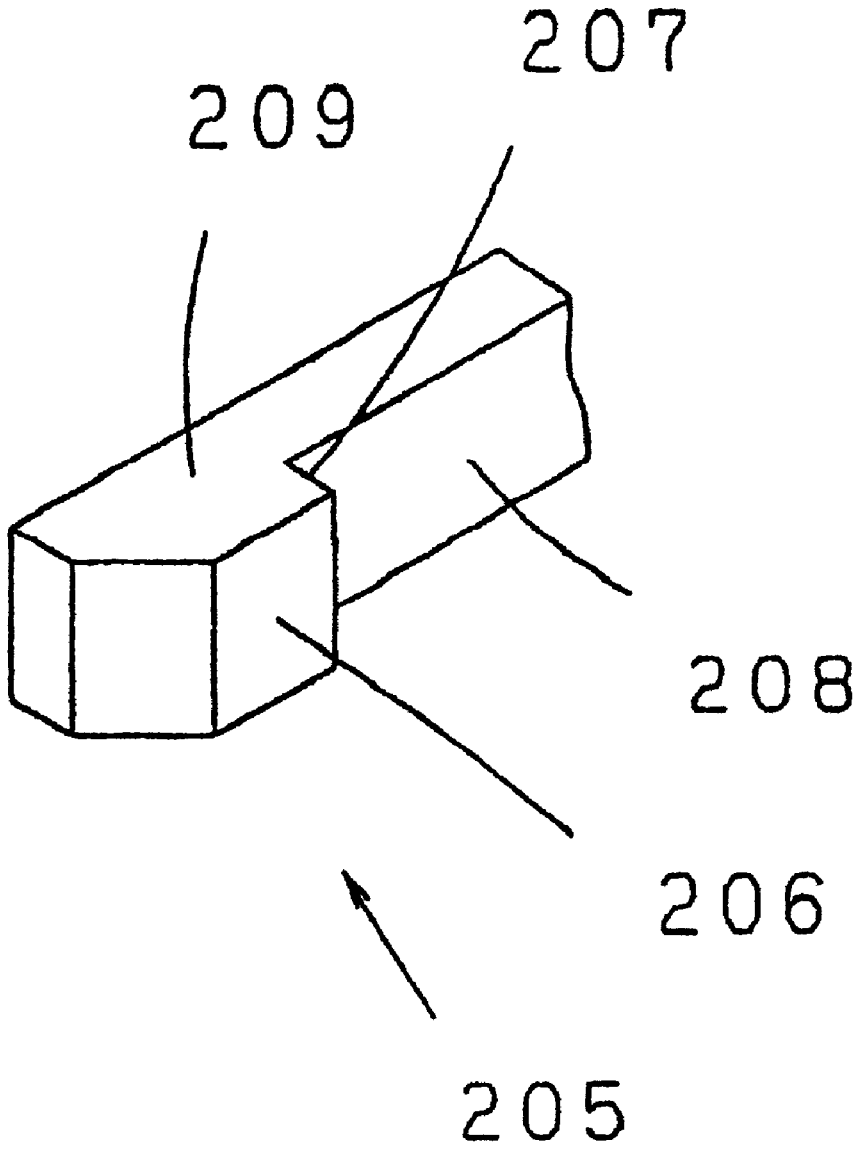
FIG. 19 is a perspective view of another connector of the prior art.

Referring now to FIG. 15, lock arms 6*c* are preferably formed from a metallic material that differs from the material of an insulating housing 4*c*. The lock arm 6*c* is folded at one end into a U-shape, to form a fixing section 30. The other end of the lock arm 6*c* forms a locking protuberance 12*c*. The locking protuberance 12*c* is identical to the locking protuberances 12, 12*a* or 12*b* described above.

Retaining grooves 31, in the insulating housing 4*c*, retain the fixing sections 30 of the lock arms 6*c* in the retaining grooves 31. The insulating housing 4*c* supports the lock arms 6*c* in a cantilever fashion, creating lock arms 6*c* which are elastically deformable.

According to this embodiment of the invention, the metallic lock arms 6*c* remain undamaged, even after repeated use. Furthermore, there is no need to form the insulating housing 4*c* from material having great elasticity, reducing the cost of the connector. To change the force required for disconnection, in addition to changing the angles r1, r2, and r3 as previously described, one can simply change the material of the lock arms 6*c* to a material having greater or less lubricating value. The force may also be varied by changing the resilience of the material, or the roughness of the mating surfaces. This inexpensively allows a change in the force required for disconnection.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims. For example, the lock arms 6, as described, project inwardly. They may, however, project outwardly, upwardly, or downwardly. The lock arms 6 can also be formed to project from the center of the receiving recess 5, or from both sides of the center of the receiving recess 5, rather then from both sides of the receiving recess 5. The tilt angles where the tapered unlocking surfaces 11, 11*a*, and 11*b* are tilted relative to the direction in which their respective locking protuberances 12, 12*a*, and 12*b* project are equal to the tilt angles r1, r2, and r3. These angles are not necessarily set to an identical angle.

What is claimed is:

1. A connector locking structure comprising:

a connector;

said connector including an insulating housing;

a plurality of terminals partially exposed to an exterior of said insulating housing;

lock arms projecting from said insulating housing;

said lock arms being elastically deformable in a direction generally normal to a direction ol insertion of said connector;

locking protuberances arc integrally formed at ends of said lock arms;

said locking protuberances having a vertical locking surface projecting in a direction generally normal to said direction of insertion of said connector;

a connector tapered unlocking projection on each of said lock arms;

said connector tapered unlocking projection having a first width, at a proximal end of said connector tapered unlocking projection with respect to said lock arm, which tapers to a second width, at a distal end of said connector tapered unlocking projection with respect to said lock arm;

said first width being greater than said second width, whereby a connector tapered unlocking surface results;

a mate connector;

said mate connector including an insulating housing;

a plurality of terminals partially exposed to an exterior of said insulating housing;

at least one indentation positioned to receive and engage said vertical locking surface, whereby pulling in a direction opposite to insertion will not remove said connector from said mate connector when said at least one indentation receives and engages said locking protuberances;

a tapered unlocking surface on each of said at least one indentation;

said tapered unlocking surface being parallel to said direction of insertion of said connector in said mate connector;

said tapered unlocking surface tapering down in a direction perpendicular to said direction of insertion of said connector in said mate connector;

said terminals of said connector and said terminals of said mate connector are connected by insertion and engagement of said locking protuberance of said connector with said indentation ol said mate connector; and said connector tapered unlocking surface slides over said tapered unlocking surface of said mate connector to displace said vertical locking surface out of locking engagement with said indentation when said connector is twisted with respect to said mate connector, whereby disengagement of said connector from said mate connector is enabled.

2. The connector locking structure according to claim 1, wherein said tapered unlocking surfaces of said indentations of said mate connector are tilted to the same angle as said tapered unlocking surfaces of said locking arms of said connector.

3. The connector locking structure according to claim 2, wherein said lock arms are integrally formed with said insulating housing of said connector.

4. The connector locking structure according to claim 2, wherein said lock arms are formed of a material differing from that of said insulating housing of said connector.

5. The connector locking structure according to claim 4, wherein said material differing from that of said insulating housing is a metallic material.

6. The connector locking structure according to claim 1, wherein said lock arms are integrally formed with said insulating housing of said connector.

7. The connector locking structure according to claim 1 wherein said lock arms are formed of a material differing from that of said insulating housing of said connector.

8. The connector locking structure according to claim 7, wherein said material differing from that of said insulating housing of said connector is a metallic material.

9. A connector system comprising:

a connector;

a mate connector mateable to said connector;

one of said mate connector and said connector including a lock arm extending toward the other of said mate connector and said connector;

said lock arm including a locking surface;

said other including an indentation into which said locking surface is resiliently urged when said connector and said mate connector are engaged;

at least a first tapered unlocking surface on said lock arm;

at least a corresponding second tapered unlocking surface on said other; and twisting of said connector with respect to said mate connector engaging said first and second tapered unlocking surfaces to raise said locking surface out of engagement with said indentation, whereby unlocking and disconnection of said connector and said mate connector is enabled.

* * * * *